United States Patent [19]

O'Neill

[11] 4,382,398

[45] May 10, 1983

[54] METHOD AND APPARATUS FOR ELIMINATING FEEDBACK IN STAGE MONITORS

[75] Inventor: R. Michael O'Neill, Meridian, Miss.

[73] Assignee: Peavey Electronics Corp., Meridian, Miss.

[21] Appl. No.: 268,648

[22] Filed: May 29, 1981

[51] Int. Cl.[3] ..... G10H 1/02

[52] U.S. Cl. ..... 84/1.19; 84/DIG. 9; 84/DIG. 10; 84/DIG. 12; 179/1 FS; 179/1 D

[58] Field of Search ..... 84/1.01, DIG. 9, 1.24, 84/1.19, DIG. 12, DIG. 10; 179/1 FS, 1 F, 1 D, 1 P

[56] References Cited

U.S. PATENT DOCUMENTS

| | | | |
|---|---|---|---|
| 3,755,749 | 8/1973 | Van Ryswyk et al. | 179/1 FS |
| 3,974,461 | 8/1976 | Luce | 84/1.19 X |
| 4,088,834 | 5/1978 | Thurmond | 179/1 FS |
| 4,106,384 | 8/1978 | Whittington et al. | 84/1.19 |
| 4,218,950 | 8/1980 | Uetrecht | 84/1.19 |
| 4,359,601 | 12/1982 | England | 179/1 D |

*Primary Examiner*—J. V. Truhe
*Assistant Examiner*—Forester W. Isen
*Attorney, Agent, or Firm*—Berman, Aisenberg & Platt

[57] ABSTRACT

Apparatus for eliminating feedback in stage monitors for selected musical instruments includes filter networks for attenuation of a broad frequency range including the entire range of frequencies contributing to the feedback. A combination of high order low-pass and high-pass filters is used to pass fundamental and second order components of a selected instrument, while attenuating the undesired feedback frequencies as well as extremely low range frequencies capable of damaging a speaker. A pair of passbands is provided, and a pair of frequency bands is suppressed, the two pairs providing alternate attenuation and pass-bands. Active filters having operational amplifiers and frequency selective circuits are used, along with buffering and summing circuits, to attain the desired frequency characteristic.

8 Claims, 3 Drawing Figures

METHOD AND APPARATUS FOR ELIMINATING FEEDBACK IN STAGE MONITORS

BACKGROUND OF THE INVENTION

1. Field of the Invention

This invention relates to stage monitors for musical instruments, and more specifically to improvements in such monitors for minimizing feedback problems arising therein by electronic filtering.

2. Prior Art

The use of electronic circuits in conjunction with musical instruments has become well known in the art. Such circuitry is typically used in various synthesizers, where variable filters are provided for achievement of particularly desired special effects. Such a system is disclosed in Whittington et al. U.S. Pat. No. 4,106,384.

Active multiple-stage distributed filters are similarly used in conjunction with electric pianos, organs, and other keyed instrument to attain desired voicing characteristics, tone coloration, and the like. Uetrecht U.S. Pat. No. 4,218,950 illustrates such use, in which undesirable upper harmonics, as well as frequencies below the fundamental are rejected to decrease intermodulation distortion and to increase isolation between the filter stages.

A further use of active filters, having amplifiers connected to capacitive networks, to provide a voltage controlled arrangement for an electronic synthesizer is disclosed in Luce U.S. Pat. No. 3,974,461.

Stage monitors for all, or a selected portion, of a musical program are used to enhance a performer's ability to adjust his own instrument to that of the overall program. For drum systems, however, such monitors introduce significant problems, such as sustained low-frequency feedback. A typical prior art approach to the feedback problem is to stuff a bass drum with pillows, blankets, or drapes, or to provide other forms of mechanical damping therefor.

The use of mechanical devices, however, tends to affect the tonal quality of the music produced by a drum, or other musical instrument, since such music is itself inherently a mechanical vibration.

While prior usage of electronic filtering circuits is known, no such circuits have been devised for minimization of a particular broad band of frequencies contributing to the feedback problem in stage monitors. As is apparent from the above described publications, typical use of electronic circuitry is in enhancement or modification of instrument output, and not in interference with a feedback loop, particularly of the type arising in a stage monitor for a percussive instrument.

SUMMARY AND OBJECTS OF THE INVENTION

It is accordingly an object of the present invention to overcome the difficulties of the prior art and to provide an improved structure for elimination of feedback in stage monitors.

It is a more specific object of the invention to provide an electronic circuit, utilizing active filtering techniques, for attenuation of a broad band of frequencies contributing to feedback in stage monitors for percussive instruments.

It is yet another object of the invention to provide an improved stage monitor in which active filtering stages are used both to attenuate a band of frequencies contributing to feedback effects and to attenuate another band of frequencies which may provide destructive mechanical oscillation to the monitor speaker.

Still another object of the invention is to provide circuitry for a stage monitor to pass a pair of frequency bands: a first band corresponding to the fundamental frequency produced by a musical instrument, as well as the second harmonic thereof, and a second band corresponding to a second, distinctive sound generated by the instrument.

Still a further object of the invention is to provide electronic circuitry having a specific frequency characteristic, in which specified components provide alternating attenuating and pass bands.

It is an additional object of the invention to provide a method for stage monitoring a selected portion of a musical program by attenuating a broad frequency band which contributes to feedback problems in such monitoring.

In accordance with the foregoing objects, an electronic circuit is provided having a plurality of filter stages for minimizing feedback from a speaker to an input of a stage monitor. The filter stages include frequency pass components for fundamental components of the selected portion of a musical program, and frequency attenuation components for particular frequency bands.

The circuit includes components for attenuating extremely low frequencies, for passing a first frequency band above the extremely low frequencies, for attenuating a second frequency band above the first band and including therein the feedback frequencies, and for passing a third band above the second band.

The circuit components include operational amplifiers and associated frequency selective networks used to determine the particular frequencies for the above described frequency bands. An input buffer is provided, which itself includes both high and low-frequency attenuation.

The buffer output is provided to a pair of parallel branches, each branch having at least one active filter stage therein. The outputs of the parallel branches are provided to a summing amplifier which includes additional high-pass filtration.

BRIEF DESCRIPTION OF THE DRAWING

The foregoing and other objects, features and advantages of the invention will become more readily apparent upon reference to the following detailed description of the preferred embodiment, when taken in conjunction with the accompanying drawings in which like numbers refer to like parts.

DETAILED DESCRIPTION OF THE PREFERRED EMBODIMENT

Figure 1:
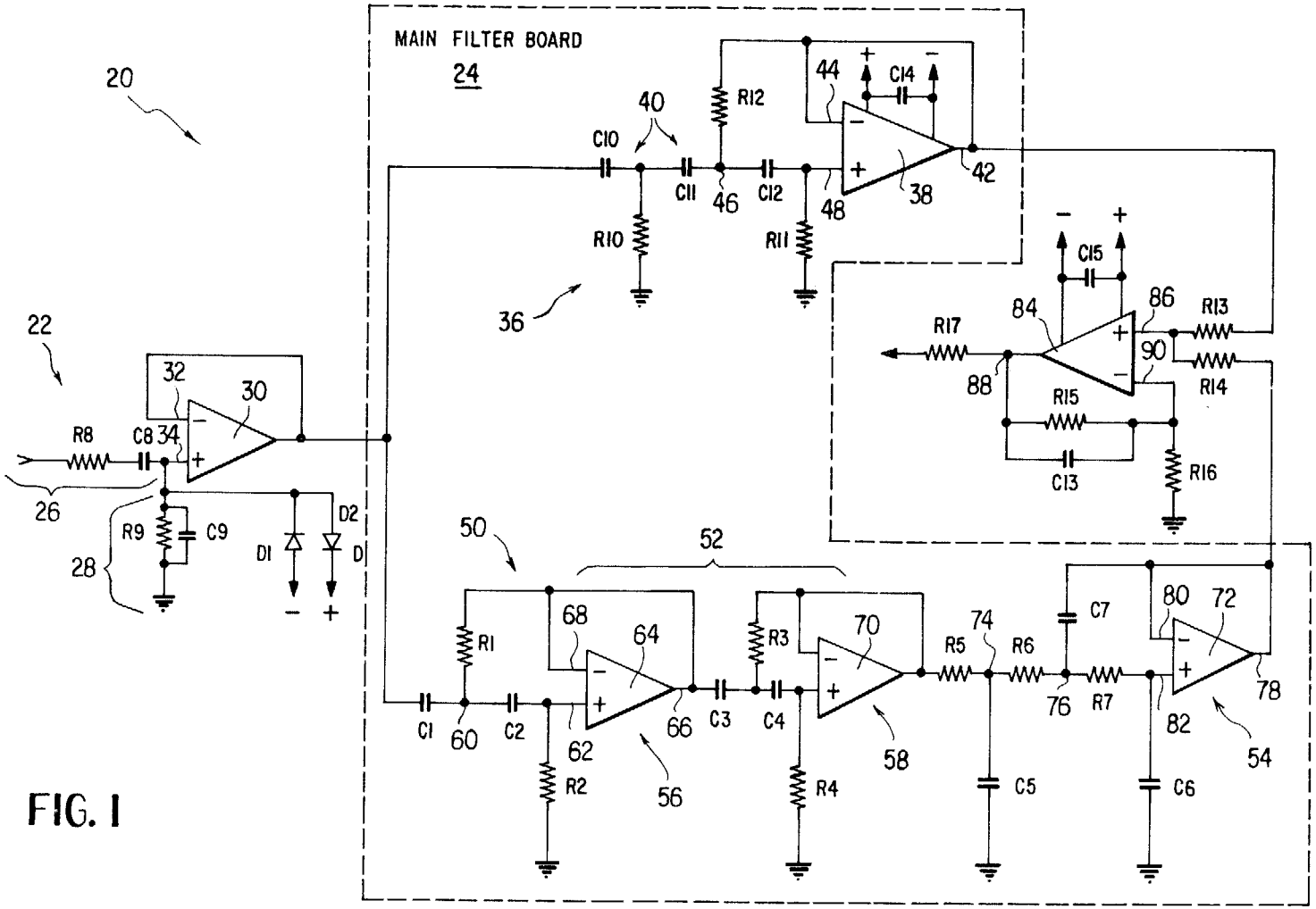
FIG. 1 shows a preferred embodiment of a circuit in accordance with the present invention.

The circuit shown in FIG. 1 provides a solution to a problem experienced by musical performers attempting to adjust their particular instrument to that of the overall program. Such adjustment is typically required in musical performances wherein high sound pressure levels are created by the musical program electronically amplified for the benefit of the patrons.

The use of electronic amplification makes it difficult for the performers to distinguish their own instruments for proper adjustment. Soundspeaker systems, known as stage monitors, are accordingly available to performers to enable better instrument and vocal definition and clarity.

Figure 3:
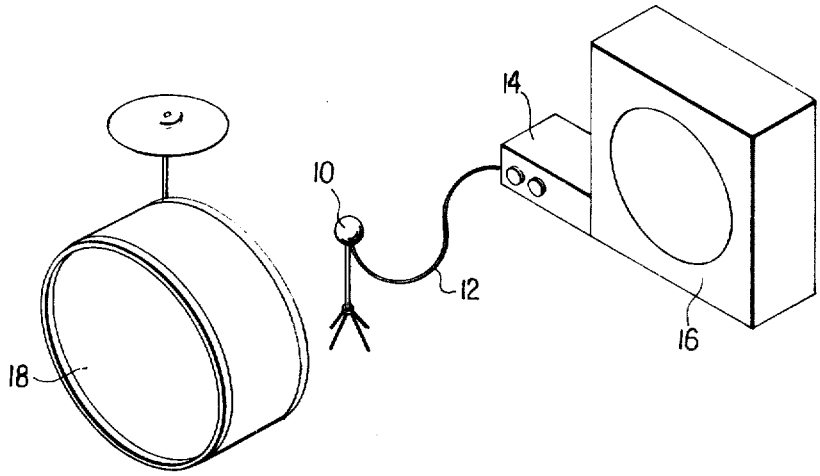
FIG. 3 shows the environment in which the invention is typically used.

A typical stage monitor system is shown in FIG. 3 of the drawing, in which a detecting means 10, which may be a microphone, for example, is used to detect a selected portion of the musical program being performed. Thus, where a specific instrument is desired to be monitored, detecting means 10 is placed adjacent that instrument. Of course, with the availability of directional microphones, the detecting means need not be placed immediately adjacent the specific instrument or instruments to be monitored. The use of electrical pickup devices may eliminate the microphone in its entirety. Thus, any type of detecting means may be used which provides the desired selectivity to enable monitoring the selected portion of the program material, whether a single instrument, a group of instruments or the entire program.

The detecting means 10 provides an output signal representative of the musical program portion to be monitored. The signal is transmitted along a wire 12 to an amplifying means 14. It is recognized that transmission may be by means of acoustic or radio frequencies, and that wire 12 may not be present. The wire is intended to symbolize a means for communicating the signal representing the selected portion to the electronic processing circuitry therefor.

Amplifying means 14 processes the signals output by the detecting means 10 and amplifies them sufficiently to drive a speaker 16, oriented to enable the performer or performers to hear their own instrument or instruments, and to take appropriate adjustment measures as necessary.

In the environment of FIG. 3, wherein the disclosed stage monitor is used to monitor a drum system 18, specific problems are presented.

After research conducted under the auspices of the assignee hereof, it has been determined that frequencies in the approximate range of 100 Hz to 700 Hz lead to undesirable and harmful feedback.

It is known to musical performers, and particularly to drummers, that the low frequencies which the stage monitor system is required to reproduce for drum systems often interact with the drum system itself. Specifically, the sound output of the speaker causes vibration of the drum, leading to oscillations having a long decay time constant. This form of low frequency feedback is perceived as a low frequency "ringing" of the drum.

Typical approaches to minimizing this low frequency feedback utilize mechanical damping of the vibrations. This is usually done by stuffing the drum with pillows, blankets, drapes, or other mechanical damping means. Obviously, such mechanical damping of the instrument's vibrations detracts from its musical output sound, as well as reducing the feedback oscillations.

Having determined that the feedback phenomenon is due to frequencies in the broad range of 100 to 700 Hz, the present invention was developed to attenuate the entire range of frequencies, rather than to provide some narrow band equalization therefor. Moreover, the invention includes components to protect the speaker 16 of the stage monitor by attenuating an additional band of extremely low frequencies.

The invention thus provides electronic equipment optimized for specifically controlling bass drum feedback in a drum monitor system.

The circuitry provided is used to pass the fundamental frequency output of the bass drum, which is in the approximate range of 50–60 Hz. Additionally, for more realistic reproduction by the monitor, the circuitry passes the second harmonic of the drum output. Thus, the entire range of approximately 50–100 Hz is passed by the present system.

In order to avoid the possibility of damage to the speaker by large mechanical excursions at extremely low frequencies, the system includes components for attenuating frequencies below approximately 50 Hz.

Rapid (approximately 15 db per octave) attenuation of frequencies above 100 Hz, at a maximum attenuation of approximately 22 db, is provided by the present system to eliminate the broad frequency band determined to cause the objectionable low frequency feedback. The entire band of frequencies between approximately 100 Hz and 700 Hz is thus eliminated.

The present invention, rather than merely providing circuitry for eliminating frequencies at or above a particular value, provides further components for assuring that the sound output of the speaker is realistic.

Specifically, in addition to the attenuation circuitry for frequencies above 100 Hz, high-pass circuits are provided to assure that frequencies above 700 Hz, up to approximately 3.5 KHz, are also passed, thus allowing the percussive sound of the drum beater hitting the bass drum head to be heard.

The present invention thus provides a substantially fixed response shape, as described below, requiring a minimum of electronic tuning and protecting the monitor system while passing the specific sounds of interest to the musician.

Referring now to FIG. 1, the inventive circuit is generally shown at 20, including an input buffer 22 and a main filter board 24.

Buffer 22 receives an input signal and provides isolation for the source thereof, which may be detecting means 10, from the main filter board 24. The buffer includes frequency selective circuits 26 and 28, comprised of RC networks R8–C8 and R9–C9, respectively, to provide first order filtering functions for both low-frequency and high-frequency attenuation. An operational amplifier 30 is connected with its output fed back to its negative input 32, while the frequency selective circuits 26 and 28 are connected to a non-inverting input 34 thereof.

The main filter board 24 includes a pair of parallel paths. A first path 36 includes a third order high pass filter, having an operational amplifier 38 and a frequency selective network 40. The network 40 includes filter capacitors C10, C11 and C12 along with resistors R10, R11 and R12 to shape the frequency characteristic of the filter.

Output 42 of amplifier 38 is fed back to the inverting, or negative input 44 thereof, as well as to a junction 46 between capacitors C11 and C12. Capacitor C12, at its other terminal, is connected to non-inverting, or positive input 48 of amplifier 38, and to resistor R11 connected therebetween and ground. Resistor R10 is connected between the junction of capacitors C10 and C11, on the one side, and ground on the other.

A second path in the main filter board 24, generally shown at 50, includes a fourth-order high-pass filter 52 and a third-order low-pass filter 54.

The fourth-order high-pass filter 52 is itself comprised of a pair of second-order high-pass filters 56 and 58 having substantially identical structures. A second order frequency selective network is provided in conjunction with an operational amplifier for each of the filters. For brevity, only filter 56 is described in detail.

The input signal to the filter, provided from the output of buffer 22, is passed through capacitor C1 to a junction 60 of capacitor C1, resistor R1, and capacitor C2. The frequency selective network includes, in addition to resistor R1 and capacitors C1 and C2, a resistor R2 from the non-inverting input 62 of operational amplifier 64 to ground. Output 66 of amplifier 64 is fed back to inverting input 68 and to resistor R1, for feedback to the non-inverting input 62.

A similar frequency selective network, comprising resistors R3, R4 and capacitors C3, C4 is provided for operational amplifier 70 to form filter 58.

Third-order low-pass filter 54 includes a frequency selective network comprising resistors R5, R6, and R7, and capacitors C5, C6 and C7, and an operational amplifier 72. The output signal of filter 58 passes through resistor R5 to junction 74, between resistor R6 and capacitor C5, the latter connected at its other terminal to ground. A further junction 76 is formed among capacitor C7 and resistor R7 and the other terminal of resistor R6. Output 78 of amplifier 72 is fed back to its inverting input 80 as well as to capacitor C7 for feedback to the positive, non-inverting input 82.

The outputs of both paths 36 and 50 are resistively connected to be summed at an input of a summing output amplifier for the invention, shown at 84. Resistors R13 and R14, respectively, are used to connect the outputs of amplifiers 38 and 72 to a non-inverting input 86. Output 88 of amplifier 84 is fed back to inverting input 90 thereof by means of an RC network comprised of resistor R15 and capacitor C13, thus providing the summing output amplifier 84 with a first-order low-pass filter function. A resistor R16 is connected between inverting input 90 and ground. A limiting resistor R17 is connected to receive the output of amplifier 84, which is used as the drive source for any suitable power amplifier whose input impedance is high in relation to the output impedance of the present device.

The present circuit may be connected to receive the output of detecting means 10 and to provide the input to amplifying means 14 of FIG. 3, or may be included within the amplifying means as an input stage or as an intermediate stage.

Advantageously, by providing the circuit as a separate structure, existing stage monitors may be adapted for monitoring bass drums without objectionable low-frequency feedback by a simple connection between the detecting means and the amplifying means, without the necessity of restructuring the entire monitor, or of purchasing an entire new monitor.

Moreover, by using active filters comprised of operational amplifiers, the various filtering stages are isolated from one another, thus enabling variation of specific components to alter particular portions of the frequency response without affecting other portions. Preferably, however, the system components are fixed at specific values, requiring minimal tuning or alteration.

For the presently contemplated use, wherein a percussive instrument, and particularly a bass drum, is monitored, the desired attenuation of extremely low frequencies as well as frequencies in the feedback range, along with passage of first and second harmonic frequencies of the drum and the higher order percussive sound frequencies is achieved by the use of the following components in the circuit of FIG. 1.

Operational amplifiers 30 and 84 are each one half of an operational amplifier type 4558. The amplifiers 38, 64, 70 and 72 are each preferably of the type 4741 CP. The remaining components are illustratively provided in the following table.

| COMPONENT | VALUE |
|---|---|
| C1, C2, C3 | |
| C4, C8 | 0.1 μf |
| C9–C12, C4 | |
| C15 | 0.033 μf |
| C13 | 470 μf |
| C5 | 0.047 μf |
| C6 | 0.0068 μf |
| C7 | 0.15 μf |
| R1 | 28 K* |
| R2, R16 | 33 K |
| R3 | 12.1 K* |
| R4 | 82.5 K |
| R5–R7 | 47 K* |
| R8 | 1 K |
| R9 | 100 K |
| R10 | 4.7 K |
| R11 | 31.6 K* |
| R12 | 1.82 K* |
| R13–R15 | 68 K |
| R17 | 0.68 K |
| D1, D2 | 1N4148 |

*1% tolerance

Figure 2:
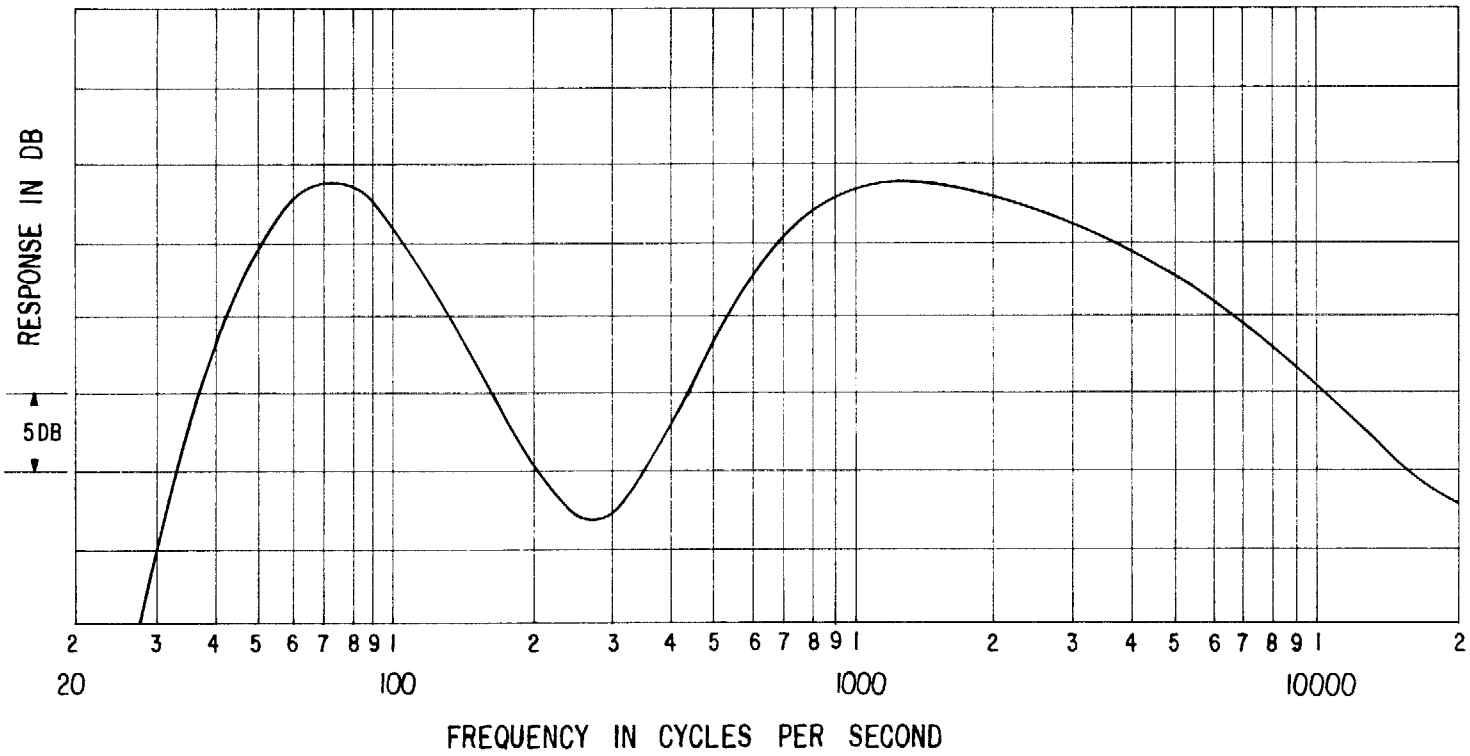
FIG. 2 shows the frequency characteristic of the circuit of FIG. 1.

Referring now to FIG. 2, the amplitude vs. frequency response of the described system is seen to provide specific attenuation of the range between 100 Hz and 700 Hz, to minimize bass drum-to-bass drum monitor feedback. The region below 50 Hz provides rapid attenuation in order to provide the previously described protection to the drum monitor system for extremely low frequencies.

Between the two attenuated ranges is the range between approximately 50 Hz and 100 Hz, passing the fundamental frequency and the second harmonic. Finally, the region between 700 Hz and approximately 3.5 KHz passes high frequency percussive timbre of the bass drum beater action.

It is thus seen that steep slopes of the frequency characteristic of the device provide for sharp attenuation of frequencies in two undesired ranges, below 50 Hz and between 100 Hz and 700 Hz. Frequencies above 3.5 KHz, not of particular concern, are attenuated at a less steep rate.

The inventive device thus provides the multiple frequency range operation for achieving the desired operating characteristics and objectives set forth therefor.

The preceeding specification describes the preferred embodiment of the invention as an illustration and not a limitation of the invention. It is appreciated that equivalent variations and modifications of the invention will occur to those skilled in the art. Such modifications, variations and equivalents are within the scope of the invention as recited with greater particularity in the appended claims, when interpreted to obtain the benefits of all equivalents to which the invention is fairly and legally entitled.

What is claimed is:

1. Apparatus for modifying the output of a stage monitor comprising an electronic filter circuit electronically connected between an input of said monitor and an output speaker of said monitor, said electronic filter circuit comprising means for attenuating substantially all frequencies below about 50 Hz, substantially all frequencies between about 100 Hz and 700 Hz, and substantially all frequencies greater than about 3,500 Hz, the amount of attenuation below about 50 Hz increasing greater than about 15 db per octave to greater than minus 15 db, the amount of attenuation between about 100 Hz and 700 Hz increasing about 15 db per octave to greater than minus 15 db at a frequency between 100 Hz and 700 Hz, and the amount of attenuation greater than about 3,500 Hz increasing about 6 db per octave to greater than minus 15 db, said filter circuit passing frequencies between about 50 Hz and 100 Hz and between about 700 Hz and 3,500 Hz.

2. The apparatus of claim 1 wherein said electronic filter circuit comprises a plurality of filter stages including:

first and second high-pass frequency filter means for passing frequencies above about 700 Hz and about 50 Hz respectively, first low-pass frequency filter means connected to said second high-pass frequency filter means for passing frequencies below about 100 Hz, and combining means for combining outputs of said high-pass and low-pass frequency filter means.

3. An apparatus as recited in claim 2 further comprising input buffer means having both high frequency and low frequency attenuation means.

4. An apparatus as recited in claim 2 wherein said combining means further includes second low-pass frequency selective means.

5. An apparatus as recited in claim 2 wherein said first high-pass frequency filter means is parallel connected with a series combination of said second high-pass frequency filter means and first low-pass frequency filter means, each of said parallel connected filter means and series combination providing an output to said combining means.

6. An apparatus as recited in claim 5 wherein said first high-pass frequency filter means comprises third order frequency selective high-pass circuitry; said second high-pass frequency filter means comprises fourth order frequency selective high-pass circuitry; and said first low-pass frequency filter means comprises third order frequency selective low-pass circuitry.

7. An apparatus as recited in claim 6 wherein said first and second high-pass frequency filter means and said first low-pass frequency filter means each comprise amplifying means connected with the respective frequency selective means thereof.

8. A method for modifying the frequency characteristic of the output of a stage monitor for monitoring a percussive musical instrument comprising the steps of attenuating substantially all electronic signals in said stage monitor having frequencies below about 50 Hz, passing electronic signals between about 50 Hz and 100 Hz, attenuating substantially all electronic signals between about 100 Hz and 700 Hz, and passing electronic signals from about 700 Hz to 3,500 Hz, the amount of said attenuations increasing at a rate of at least 15 db per octave to greater than minus 15 db, and attenuating electronic signals above 3,500 Hz at a rate of about 6 db per octave.

* * * * *